US010207845B2

(12) United States Patent
Levy Sarraf

(10) Patent No.: US 10,207,845 B2
(45) Date of Patent: Feb. 19, 2019

(54) CHILD RESISTANT CAP WITH FAIL-SAFE BREAKAWAY

(71) Applicant: Natalie Levy Sarraf, Santa Monica, CA (US)

(72) Inventor: Natalie Levy Sarraf, Santa Monica, CA (US)

( * ) Notice: Subject to any disclaimer, the term of this patent is extended or adjusted under 35 U.S.C. 154(b) by 4 days.

(21) Appl. No.: 15/264,581

(22) Filed: Sep. 13, 2016

(65) Prior Publication Data

US 2017/0166366 A1 Jun. 15, 2017

Related U.S. Application Data

(60) Provisional application No. 62/217,945, filed on Sep. 13, 2015, provisional application No. 62/317,423, filed on Apr. 1, 2016.

(51) Int. Cl.

| | |
|---|---|
| ***B65D 50/02*** | (2006.01) |
| ***A61J 1/20*** | (2006.01) |
| ***A61J 1/14*** | (2006.01) |
| ***B65D 51/00*** | (2006.01) |

(52) U.S. Cl.

CPC ..... *B65D 50/02* (2013.01); *A61J 1/1406* (2013.01); *A61J 1/1425* (2015.05); *A61J 1/2096* (2013.01); *B65D 51/002* (2013.01)

(58) Field of Classification Search

CPC ..... B65D 50/02; A61J 1/2096; A61J 1/201

USPC ..... 215/247, 249; 220/345.1–345.6; 604/415

See application file for complete search history.

(56) References Cited

U.S. PATENT DOCUMENTS

| | | | | |
|---|---|---|---|---|
| 5,931,828 A * | 8/1999 | Durkee | B65D 51/002 215/247 |
| 2015/0096992 A1* | 4/2015 | Hoff | B65D 47/286 220/345.1 |

* cited by examiner

*Primary Examiner* — James N Smalley
(74) *Attorney, Agent, or Firm* — Law Offices of Natan Epstein

(57) ABSTRACT

A closure with a self-resealing elastomeric septum has a shutter slidable between a closed position over the septum and an open position for exposing the septum. The shutter is spring biased towards the closed position, and may be pushed and held away from the closed position with the tip of an oral syringe to gain access for penetration of the elastomeric septum. The closure may have an upper portion mounted to a lower portion fastened for closing a container. A conduit extends through the upper and lower portions to the interior of the container. A break-away connection is adapted to preferentially break or separate when a sufficient bending or twisting force is applied to the upper portion relative to the lower portion. The conduit may be normally closed by a self-resealing elastomeric septum provided in the lower portion and a slidable shutter may be provided on the upper portion.

13 Claims, 5 Drawing Sheets

CHILD RESISTANT CAP WITH FAIL-SAFE BREAKAWAY

BACKGROUND OF THE INVENTION

Medications accidentally left within reach of unsupervised young children result in all too many emergency hospitalizations every year as a result of overdose consumption of such medications. To minimize such incidents various child resistant closures have been developed which require a degree of adroitness not usually found among small children but within the capability of an ordinary adult.

The invention described here is one such child resistant closure suitable for liquid medications such as cough syrup and other medications which although readily available may contain ingredients which can be harmful if taken in quantities beyond a recommended dosage.

Liquid medications are commonly administered to children using disposable oral syringes which allow a dose to be carefully measured and conveniently delivered to the child's mouth. The oral syringe has a syringe barrel with a narrow orificed tip at one end and an opposite open end in which slides a plunger used to draw liquid through the tip into the barrel, and to expel the liquid for delivery from the barrel through the tip into the child's mouth.

In certain prior child resistant caps for such applications a cap was provided with an elastomeric self-reclosing septum, sometimes precut with a short slit through the septum center, such that the tip of an oral syringe can be pressed through the septum into the medication bottle and a dose of the liquid drawn into the syringe. When the syringe is withdrawn from the septum the septum recloses. While such elastomeric closures provide a degree of protection for small children against access to the bottle contents, a further degree of protection is desirable.

Child resistant bottle caps have been developed in an ongoing effort to prevent accidental overdosing of children with household medications. Exemplary of such caps are those having two caps one mounted over the other. The inner cap is engaged as by threading to the neck of the medication bottle and the two caps are constructed such that turning force is transmitted from the accessible upper cap to the underlying inner cap only by application of some additional force such a downward pressure or radial compression to the upper cap. Failing such additional force the upper cap merely turns freely on the inner cap and the inner cap does not release from the bottle neck. The safety cap is designed such that a young child either lacks sufficient strength or manual dexterity to open a medication container provided with such safety cap.

A continuing concern relates to the possibility that a child resistant cap could become detached from the medication bottle as a result of sideways bending or tearing of the cap assembly until it actually breaks off from the neck of the bottle, possibly resulting in unrestricted access to the bottle contents.

This invention addresses this risk by providing a fail-safe breakaway feature which preserves closure and keeps the bottle or container sealed against access to its contents in the event that the child or tamper resistant cap is broken or torn away.

The improved safety cap has an upper portion which carries a child resistant cap, which may be of any design configured to resist opening by a typical young child, mounted to a lower portion which is securely attached to the bottle. A cap conduit passes through both the lower and upper portions of the cap and is open at a lower end to the interior of the bottle or container and terminates at an upper end in a discharge opening. The upper portion is attached to the lower portion of the cap assembly through a break-away connection designed and constructed so as to preferentially break or separate when a sufficient bending or twisting force is applied to the upper portion relative to the lower portion. The break-away connection is selectively weakened by design to fail before the lower portion becomes separated from the bottle neck or container.

An inner closure is provided in the lower portion for normally closing the conduit to flow of liquid from the bottle interior. The inner closure may be of a self-resealing type. For example, the inner closure may be an elastomeric septum configured to allow passage of a liquid transfer implement such as the tip of an oral syringe by distending and then returning to a substantially sealed condition following withdrawal of the syringe tip.

The lower portion may be attached to the container or bottle by any means sufficiently resistant to separation. For example, the lower portion may be a plug of elastomeric material tightly press fitted into the neck of a medication bottle to resist extraction from the bottle neck by any force lesser than required to cause separation of the upper portion through physical failure of the break-away connection. Alternatively, the lower portion may be formed integrally in one piece with the container or bottle neck.

The break-away connection can be constructed in a variety of ways. For example, a mechanical connection using resilient interlocking parts of a suitable plastic resin or elastomer may be provided so as to separate by resilient deformation of the interlocking parts under sufficient strain applied to the upper portion, thereby freeing the upper portion from the lower portion. In another form of the invention the upper and lower portions may be joined by an adhesive selected to fail preferentially at the adhesive junction in response to application of sufficient bending, pulling or twisting force to the upper portion, releasing the upper portion to leave the lower portion in the bottle neck or other opening of the container.

The inner closure provided for closing the portion of the conduit passing through the lower portion remains in place following detachment of the upper portion, and effectively continues to seal the container against access to its contents.

In normal usage of the cap assembly here described an adult or supervising user actuates the child resistant cap on the upper portion of the assembly to gain access to the upper end of the conduit. A liquid transfer implement such as the tip of an oral syringe or a pipette is introduced into the conduit and passed through the inner seal to enter the medication container. A medication dose is drawn into the implement which is then removed from the cap assembly, allowing the inner seal to return to a substantially sealed condition.

DETAILED DESCRIPTION OF THE PREFERRED EMBODIMENT

This invention provides an improved a child resistant bottle cap assembly including a fail-safe break-away capability which preserves closure in the event that the external cap assembly is broken off.

Figure 1:
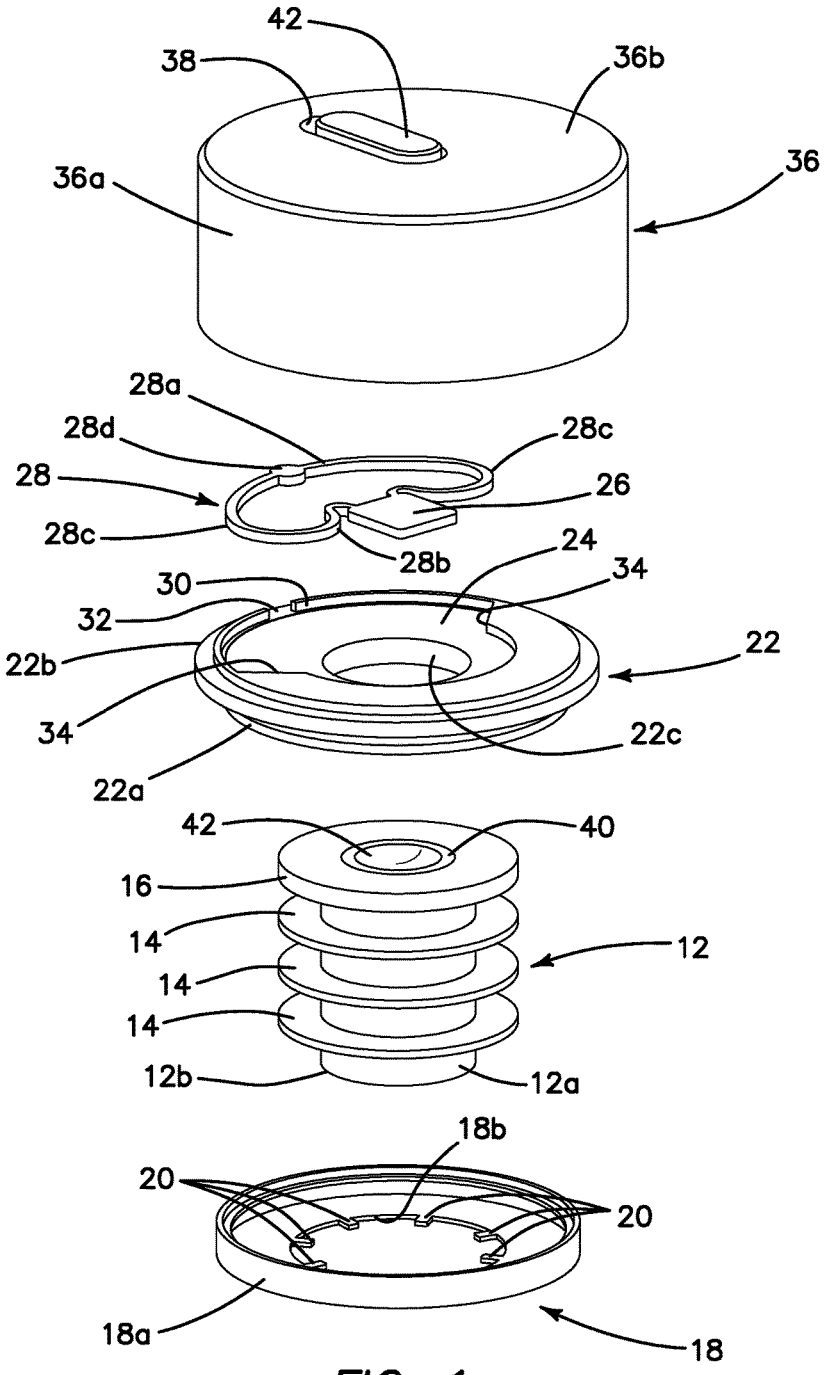
FIG. 1 is an axially exploded view of a safety cap according to this invention shown in top side view.

With reference to the accompanying drawings wherein like elements are designated by like numerals, FIG. 1 shows in exploded perspective view the components of the safety cap assembly generally designated by numeral 10. Cap assembly 10 includes a plug 12 of elastomeric material which has annular ribs 14 of similar diameter encompassing a plug body 12*a*, and a circular top plate 16 of diameter slightly larger than ribs 14.

Figure 4:
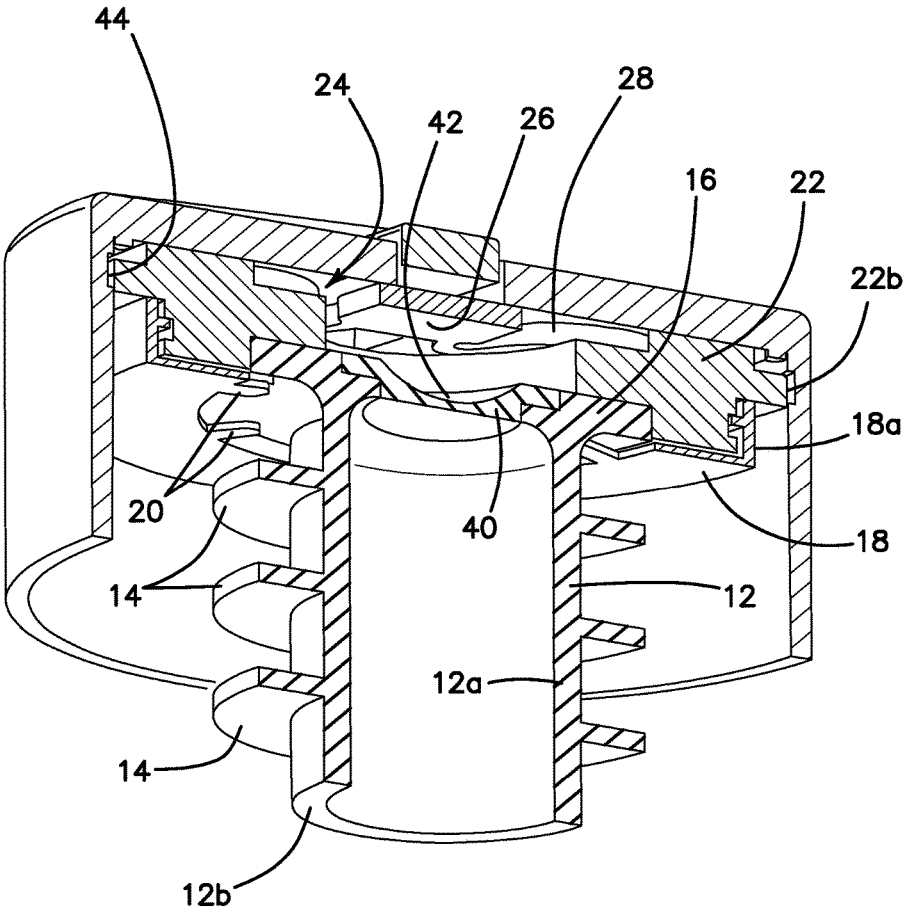
FIG. 4 is a vertical section in perspective view of the assembled safety cap of FIG. 1.
Figure 5:
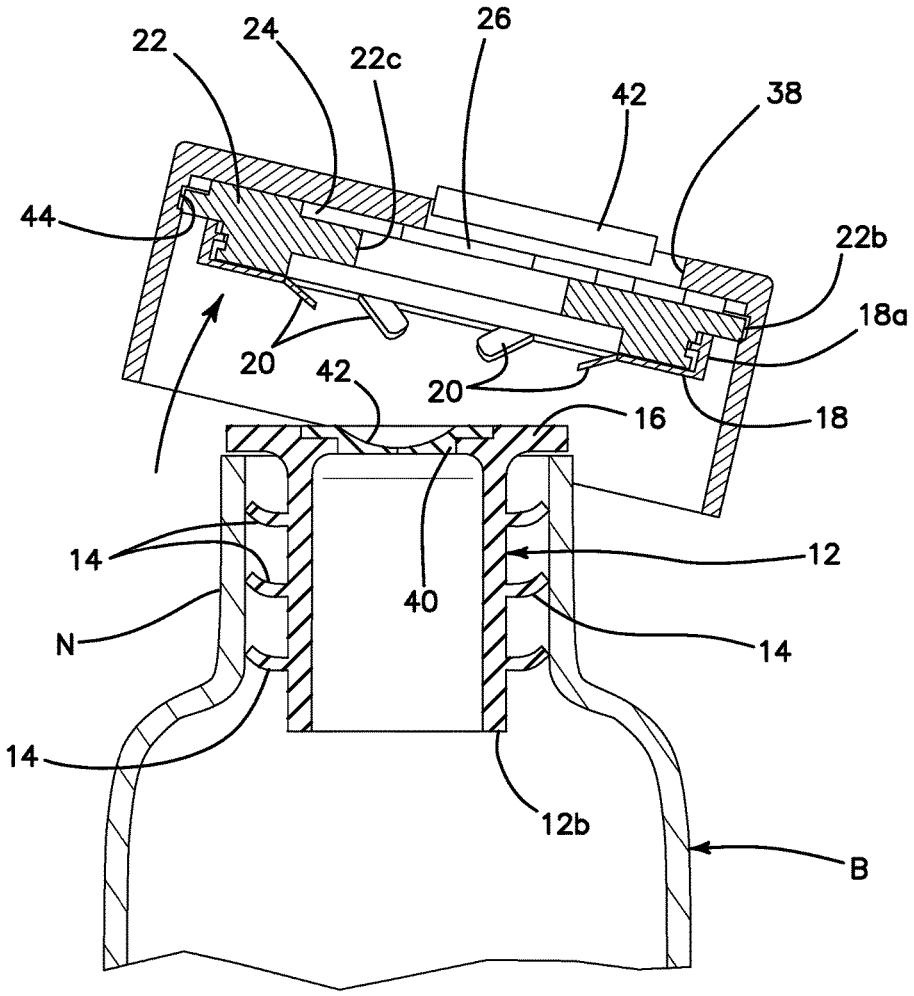
FIG. 5 is a vertical cross section showing how the safety cap breaks away from the plug and illustrating how the plug with the elastomeric septum remain in the neck if the bottle.

The plug 12 has a self-resealing elastomeric septum type closure 40 which can be penetrated with the tip of an oral syringe. The septum may be of elastomeric material softer than the material of plug 12, with a dished depression 42 in the center as best seen in the sections of FIGS. 4 and 5. As seen in the same FIGS. 4 and 5 the plug body 12*a* is hollow and open at its lower end 12*b*. The minimum thickness of the septum 40 in the dished central area of the septum is relatively thin, so that a tip of a liquid transfer implement such as an oral syringe, when manually pushed with modest force will penetrate through the septum and have access to the interior of a container closed by plug 12. The penetration may be by tearing a small slit in the initially unbroken septum material with the transfer implement or preferably, by pre-cutting a small slit in the septum center to facilitate penetration. In either case, the septum is constructed to be self-reclosing after withdrawal of the liquid transfer implement to return the septum to a substantially sealed condition.

Figure 2:
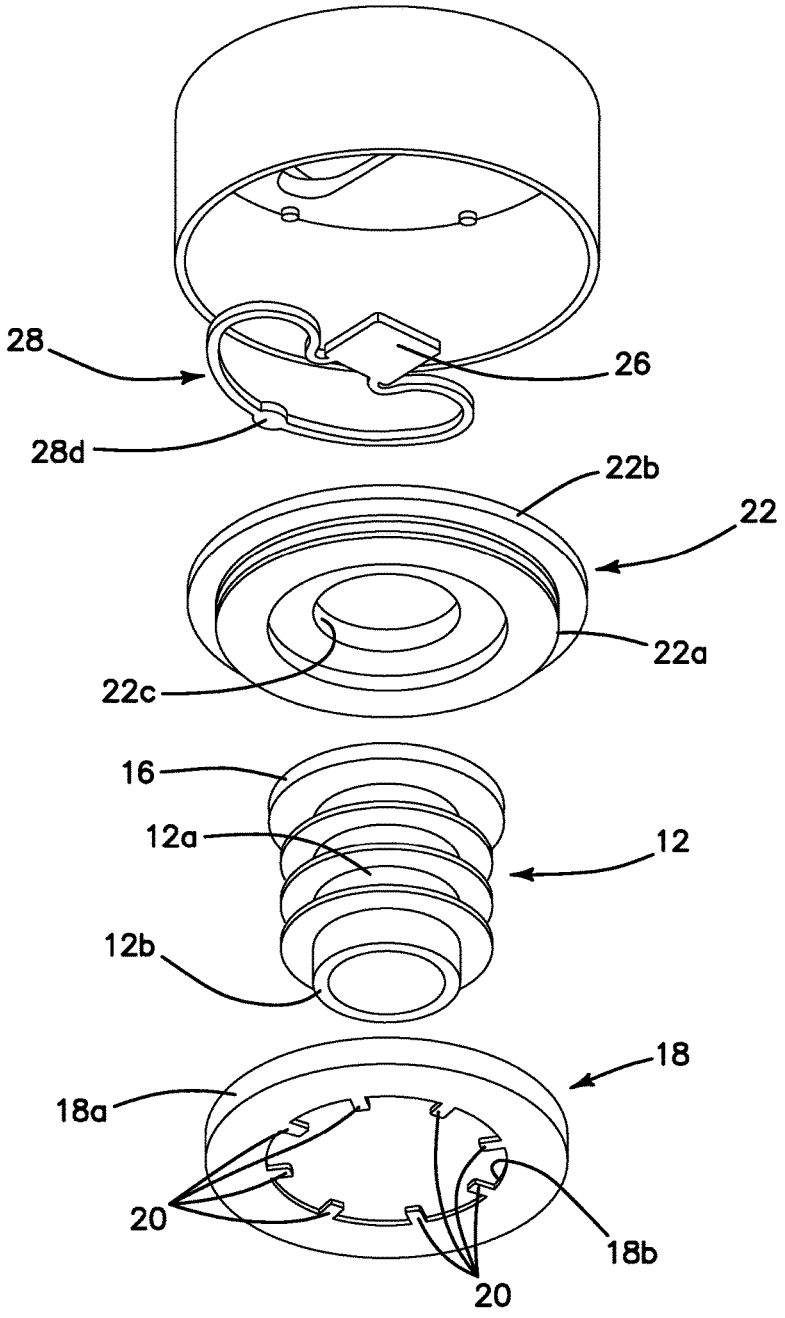
FIG. 2 is an axially exploded view of the safety cap of FIG. 1 shown in bottom side view.

Turning to FIGS. 1 and 2, a retainer disk 18 has a circular side wall 18*a* and a central aperture 18*b* into which extend a series of radial tabs 20. The inside diameter described by the radially inner free ends of tabs 20 is sufficient to admit passage of ribs 14 of plug 12 but not to pass the diameter of top plate 16, such that the plug 12 may be dropped through aperture 18*b* and remains with top plate supported on tabs 20 within retainer disk 16 with most of plug body 12*a* and ribs 14 suspended below retainer disk 18.

A carrier disk 22 has an underside 22*a* of reduced diameter configured to make a snap fit engagement with the side wall 18*a* of retainer disk, and a top side 22*b* of larger diameter greater than the outside diameter of retainer disk 18. The upper side of retainer disk 18 also defines a generally semi-circular recess 24 best seen in FIG. 3.

Figure 3:
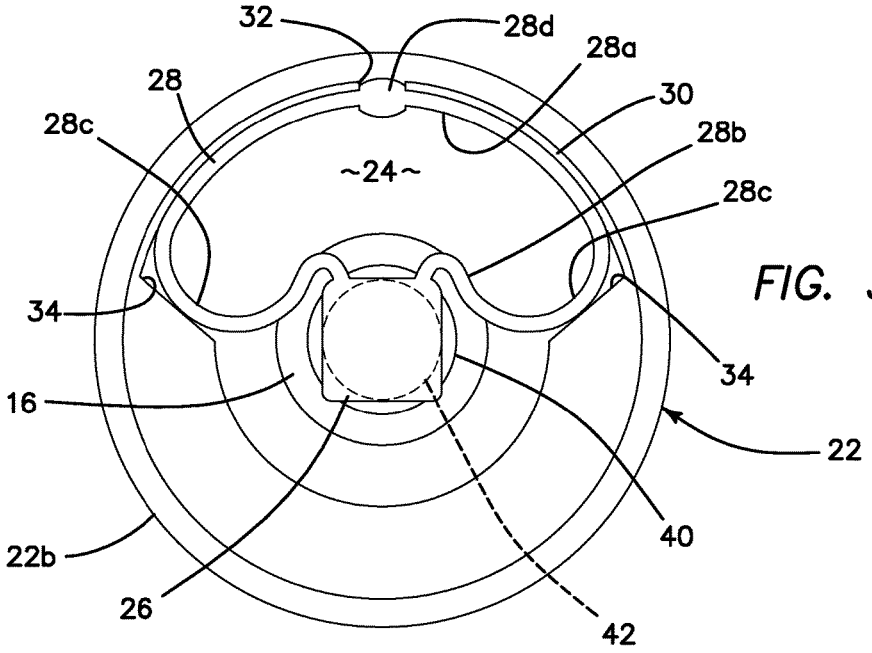
FIG. 3 is a top view of the carrier disc showing the spring loaded shutter in normal closed position over the septum indicated in phantom lining.

A shutter 24 which may be of generally rectangular shape is formed integrally with a somewhat heart shaped spring 26. The shutter 24 and spring 26 may be molded as a planar, single piece structure of resilient plastic. Spring 26 has two side lobes 26*c* which form a convex outer portion 26*a* and a concave inner portion 26*b* from which extends the shutter 24. The spring 26 is sized such that rear portion lies against the side wall 28 of carrier disk 22 and the shutter 24 is centered on carrier disk 22, as seen in FIG. 3. Midway between the side lobes in outer portion 26*a* of the spring is an enlarged bulb shape 26*d* which seats into a break 32 cut in circumferential side wall 28 of the carrier disk and serves to help keep spring 26 from sliding within recess 24. Side lobes 26*c* of spring 26 are further supported against displacement in recess 24 between circumferential end walls 34 of the recess.

A top cap 36 has a side wall or skirt 36*a* which encompasses the outside diameter of carrier disk 22 while the top 36*b* of the cap lies over and covers the top side of carrier disk 22. An elongated access slot 38 is formed in cap top 36*b* as best seen in FIGS. 1, 4 and 5. Slot 38 is generally radial extending approximately from the center of cap top 36*b* to a point near the side wall 36*a*. A removable tab 42 may be provided in slot 38 which can be peeled or pulled out after purchase of the product by the consumer or end user of the product as assurance of safety. The access slot 38 in the illustrated embodiment lies along a radial line which extends between shutter 24 and bulb 26*d*. An internal circumferential slot 44 in cap 36 receives the outer edge of carrier disc 22 in a snap fit, thereby capturing the spring/shutter element 28, 26 in recess 24 and securing the retainer disc 18, carrier disc 22 and cap 36 in assembled relationship as in FIG. 4.

Figure 3A:
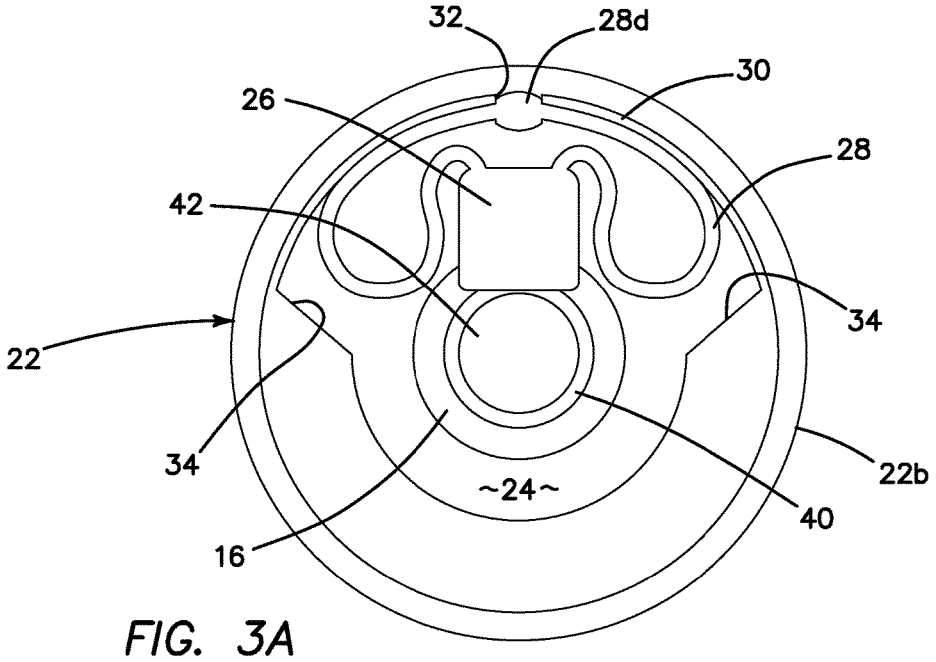
FIG. 3A is a top view as in FIG. 3 showing the shutter pushed away against the spring to expose the underlying septum.

The shutter 26 normally lies over the center of the plug, i.e. covers the septum 40 and blocks access to the septum by any implement which could be inserted through the access slot 38 of cap 36. However, the shutter 26 can be pushed aside, radially outward along the direction of slot 38 and against the urging of spring 28. This may be accomplished by using the tip of an oral syringe as a tool: the syringe tip is inserted into slot 38 on the side opposite to the spring 28 so that the tip can be brought against the free side edge of the shutter 26. The syringe tip is then pushed radially outward along the slot 38 while maintaining contact against the shutter 26 to displace the shutter to an open position depicted in FIG. 3A, deforming and compressing the heart shaped spring 28 to the condition shown in FIG. 3A, and thereby sliding the shutter 26 away from the cap center to expose the underlying septum 40. At this point the syringe tip can be advanced against and through the septum center and into the bottle B. In typical use, the bottle is inverted over the inserted oral syringe tip and liquid medication is drawn into the syringe.

Once the desired dose is drawn into the oral syringe, the syringe tip is withdrawn from the septum 40, thus allowing the compressed heart shaped spring 28 to distend to its normal shape of FIG. 3 thereby releasing the shutter 26 to its normally centered protective position over the septum 40.

The carrier disk 22 snaps to the retainer disk 18 to capture the top plate 16 of the plug 12, thereby retaining the safety cap assembly to the plug 12. The assembled discs 18 and 22 are held to plug 12 by tabs 20 which extend under the top plate 16. The central aperture 18*b* of retainer disc 18 is of diameter larger than the diameter of top plate 16 so that the top plate is prevented from falling through the central opening only by tabs 20. The tabs 20 are constructed to resist pulling and bending forces encountered in normal usage of the cap assembly. However, if subjected to abusive pulling or bending force, tabs 20 yield by bending and breaking to allow retainer disk 18 to be pulled off the plug 12 by passing top plate 16 through central aperture 18*b*, a condition illustrated in FIG. 5.

However, even after the safety cap assembly has been destructively removed in this fashion, the container or bottle B remains closed against access to its contents by the plug 12 and septum 40 which remain in sealing press-fit within bottle neck N.

While a particular embodiment has been described and illustrated for purposes of clarity and example it will be understood that many changes, modifications and substitutions will be apparent to those having only ordinary skill in the art without departing from the scope of this invention which is defined only by the following claims.

What is claimed is:

1. A plug adapted to make a close fit in a bottle neck, a self-resealing elastomeric septum in said plug, said septum configured for penetration with the tip of an oral syringe, a shutter slidable between a closed position over said septum and an open position for exposing said septum, and a spring normally urging said shutter towards said closed position, arranged and configured such that said shutter may be pushed and held away from said closed position with the said tip of an oral syringe to gain access for penetration of said elastomeric septum, a top plate fastened to said plug, and a cap over said top plate, said cap secured to said plug and wherein said spring and said shutter are contained between said cap and said top plate.

2. The plug of claim 1 wherein said cap is slotted for defining restricted access to said shutter necessitating use of a narrow tool including the said tip of an oral syringe for moving said shutter away from said closed position.

3. The plug of claim 1 wherein said cap is slotted for admitting the said syringe tip into engagement with said shutter.

4. The plug of claim 1 wherein said shutter is spring loaded by a spring co-planar with displacement of said shutter and transverse to a center axis of said plug.

5. The plug of claim 1 wherein said top plate is a top surface integral with said plug.

6. A cap assembly, comprising a plug adapted to make a close fit in a bottle neck, a self-resealing elastomeric septum in said plug, said septum configured for admitting the tip of an oral syringe, a shutter over said septum slidable between a closed position and an open position, a spring normally urging said shutter towards said closed position, a cap over said plug, said cap slotted for admission of a said oral syringe tip into engagement with said shutter such that said shutter may be pushed against said spring urging and held away from said closed position with the said tip of an oral syringe to gain access for penetration of said elastomeric septum.

7. The plug of claim 6 wherein said shutter is spring loaded by a spring co-planar with displacement of said shutter and transverse to a center axis of said plug.

8. The plug of claim 6 wherein said spring and said shutter are contained between said cap and said plug.

9. The plug of claim 6 further comprising a frangible connector releaseably securing said cap to said plug.

10. The plug of claim 7 wherein said shutter is integral with said spring.

11. A safety cap assembly for use with a plug adapted to make a close fit in a bottle neck, the plug having a self-resealing elastomeric septum configured for penetration with the tip of an oral syringe, said cap assembly comprising:

a shutter carrier, a shutter slidable on said carrier between a closed position over said septum and an open position for exposing said septum, a spring normally urging said shutter towards said closed position, a cap fastened to said shutter carrier slotted for admission of the said tip of an oral syringe tip into engagement with said shutter, arranged and configured such that said shutter may be pushed and held away from said closed position with the said tip of an oral syringe to gain access for penetration of said elastomeric septum, and a frangible connector for securing said shutter carrier to said plug.

12. The plug of claim 11 wherein said shutter is spring loaded by a spring co-planar with displacement of said shutter and transverse to a center axis of said plug.

13. The plug of claim 12 wherein said spring and said shutter are contained between said cap and said shutter carrier.

* * * * *